US005246229A

United States Patent [19]

Carey

[11] Patent Number: 5,246,229

[45] Date of Patent: Sep. 21, 1993

[54] STREET HOCKEY APPARATUS

[76] Inventor: Thomas C. Carey, 9005 Deering, Livonia, Mich. 48150

[21] Appl. No.: 993,645

[22] Filed: Dec. 21, 1992

[51] Int. Cl.[5] ..... A63B 71/00

[52] U.S. Cl. ..... 273/127 C; 273/57.2

[58] Field of Search ..... 273/127 R, 127 A, 127 B, 273/127 C, 127 D, 57.2

[56] References Cited

U.S. PATENT DOCUMENTS 3,840,228 10/1974 Greaney .
3,856,298 12/1974 Frantti .
4,083,561 4/1978 Daffer, Jr. .
4,489,940 12/1984 Amundson .
4,579,344 4/1986 Meggs ..... 273/127 B
4,615,528 10/1986 York .

FOREIGN PATENT DOCUMENTS 2640514 6/1990 France ..... 273/127 C

*Primary Examiner*—V. Millin
*Assistant Examiner*—Raleigh W. Chiu
*Attorney, Agent, or Firm*—Charles W. Chandler

[57] ABSTRACT

A street hockey goal has a tubular frame with a net for catching a hockey ball, the silhouette of a goal tender mounted at the goal frame opening, and a slanting floor panel for returning a ball caught by the net, toward the player.

11 Claims, 3 Drawing Sheets

STREET HOCKEY APPARATUS

BACKGROUND OF THE INVENTION

This is related to street hockey goals, and more particularly to a street hockey goal having a net for receiving the ball, and a slanting floor panel for returning the ball to the player.

Goals of the type having a frame that is mounted on the ground, and a net that forms a pocket for receiving the playing object, such as a puck or ball, are well known in the art. See for example, U.S. Pat. No. 3,856,298 which was issued Dec. 24, 1974 to Paul R. Frantti; U.S. Pat. No. 4,489,940 which was issued Dec. 25, 1984 to Arthur G. Amundson; U.S. Pat. No. 3,840,228 which was issued Oct. 8, 1974 to Dean F. Greaney; U.S. Pat. No. 4,083,561 which was issued Apr. 11, 1978 to Fred R. Daffer, Jr. and U.S. Pat. No. 4,615,528 which was issued Oct. 7, 1986 to Henry A. York.

The Daffer and York patents show ball return features. Both have a ball return feature comprising a floor formed of a net for returning a soccer ball toward the player. Neither of these devices is satisfactory for returning a relatively small, hard, street hockey ball.

SUMMARY OF THE INVENTION

The broad purpose of the invention is to provide an improved goal which may be used either for practice or for playing purposes for street hockey or ice hockey. The goal has a frame with a front opening. The frame supports a net forming a pocket for receiving the ball. A floor panel is mounted on the bottom of the frame interior. The floor panel is relatively rigid and inclined such that a ball being caught by the net, drops down onto the floor panel and rolls out toward the user.

A silhouette of a goal tender may be easily strapped on the front opening for practice purposes.

Still further objects and advantages of the invention will become ready apparent to those skilled in the art to which the invention pertains, upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT OF THE INVENTION

Figure 1:
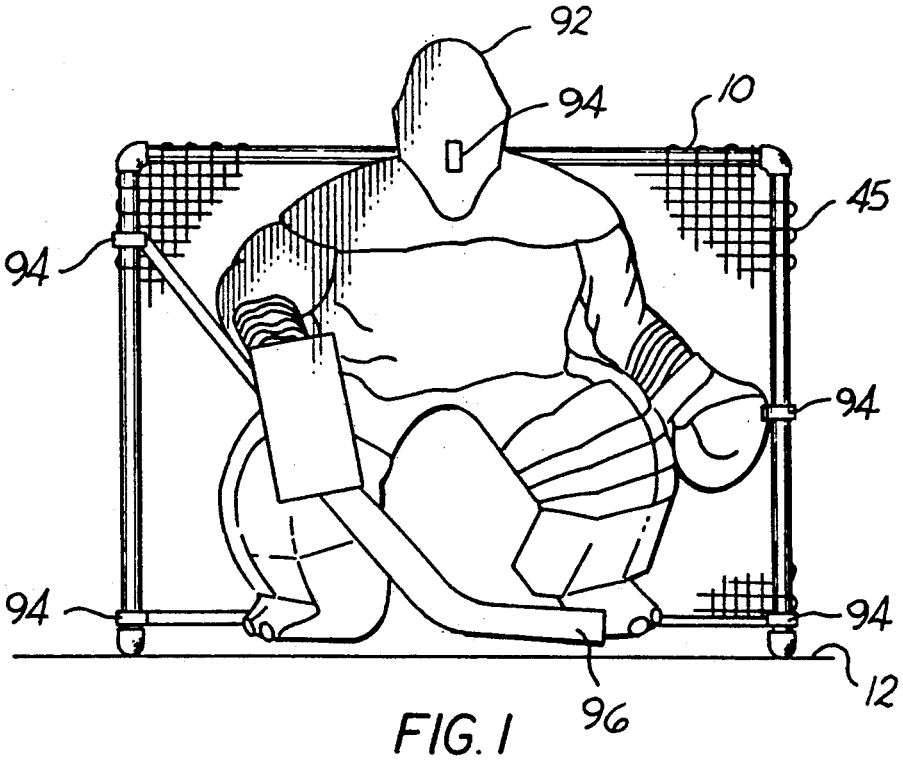
FIG. 1 illustrates a front elevational view of a goal illustrating the preferred embodiment of the invention.
Figure 2:
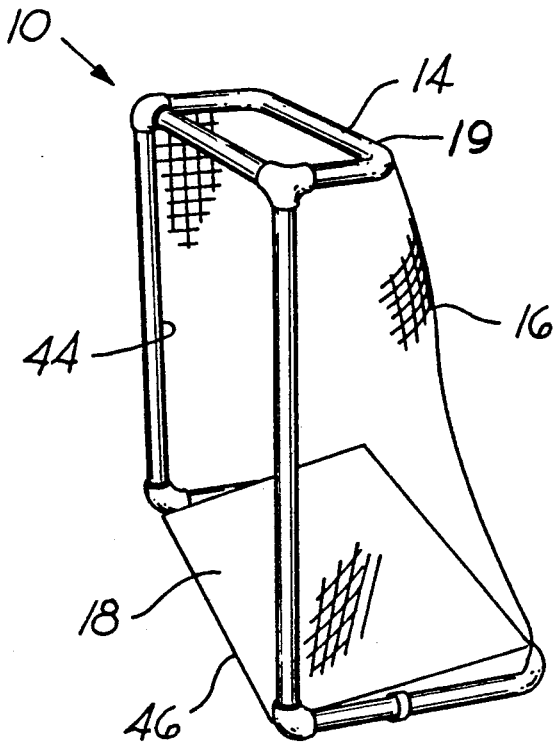
FIG. 2 is another view illustrating the goal with the goal tender silhouette removed.

Referring to the drawings, FIGS. 1 and 2 illustrate a goal 10 mounted on a playing surface 12. Goal 10 comprises a plastic tubular frame 14. Net 16 is mounted on the frame. A floor panel 18 is mounted in the frame beneath the net.

Figure 7:
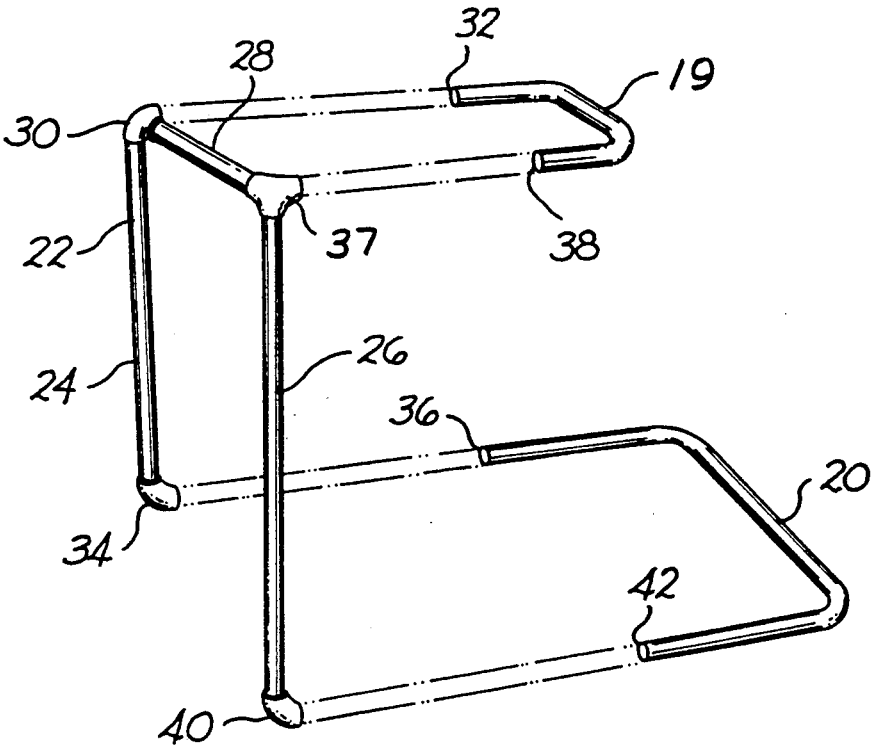
FIG. 7 is an exploded view of the tubular frame.

Referring to FIGS. 2 and 7, frame 10 comprises a plastic, tubular upper U-shaped element 19 and a lower generally U-shaped element 20 that is somewhat larger than upper element 19. A third U-shaped element 22 comprises an upright vertical leg 24, a second upright vertical leg 26 and a horizontal arm 28. The upper end of leg 24 has an elbow 30 with an appropriate opening for tightly but releasably receiving the end 32 of U-shaped element 19. The lower end of leg 22 has another elbow 34 with an opening for tightly but releasably receiving the end 36 of lower element 20.

Upper elbow 30 also has an opening for tightly but releasably receiving the end of arm 28. An elbow 37 is mounted on the upper end of leg 26 and has an opening for tightly but releasably receiving the end 38 of element 19. Another elbow 40 is mounted at the lower end of leg 26 and has an opening for tightly but releasably receiving the end 42 of lower element 20. The three generally U-shaped frame elements can be quickly disassembled for storage, or assembled with the upper and lower U-shaped elements 19 and 20, generally parallel to one another. The overall configuration is somewhat standardized for street hockey games.

Net 16 is connected to legs 22, 26, upper element 19 and lower element 20 by stringing the tubular members through the appropriate loops in the net to form a somewhat flexible pocket in the frame behind a front opening 44 defined by legs 24, 26 and arm 28. FIG. 1 illustrates the typical way the frame member is inserted through the net loops at 45.

Figure 3:
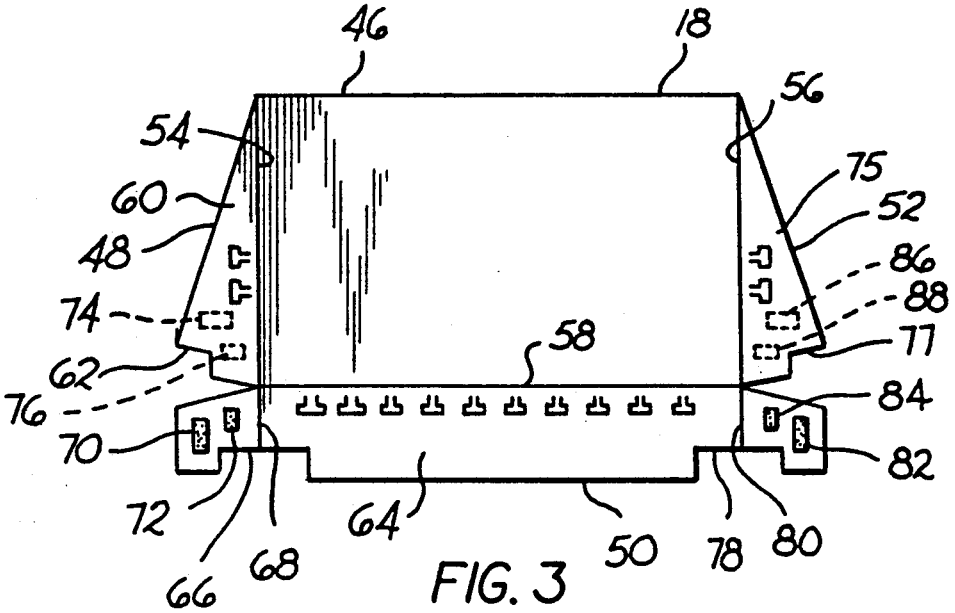
FIG. 3 is a plan view of the floor panel with its side edges unfolded.

Floor panel 18 is formed of a stiff plastic material, and has 4 edges 46, 48, 50 and 52 as illustrated in FIG. 3. When the floor panel is being prepared for use, side edge 48 is bent along fold line 54, that is, perpendicular to front edge 46. Similarly, side edge 52 is bent downwardly along fold line 56, parallel to fold line 54. Rear edge 50 is bent along a third fold line 58 that is parallel to front edge 46 to form a rectangular floor.

Side edge 48 is bent along fold line 54 to form a somewhat triangular side panel 60 having a cut-out section 62 adjacent the generally rectangular rear wall 64 formed when rear edge 50 is bent about fold line 58. Rectangular section 50 has a three sided cut-out section 66 bent along fold line 68 that forms an extension of fold line 54.

A pair of hook fabric fastener patches 70 and 72 are attached to the top surface of the end of rear wall 64, as illustrated. A pair of complementary loop fabric fastener patches 74 and 76 are attached on the underside of triangular section 60.

Similarly, the opposite side edge 52 is bent along fold line 56 to form a generally triangular side wall 75 having cut-out portion 77. The end wall 64 adjacent triangular section 74 also has a three sided cut-out portion 78 adjacent a fold line 80 that forms an extension of fold line 56. A pair of hook fabric fastener patches 82 and 84 are attached to the top edge of the rear wall. A second pair of complementary loop fabric fastener patches 86 and 88 are attached to the underside of triangular side wall 75.

Figure 4:
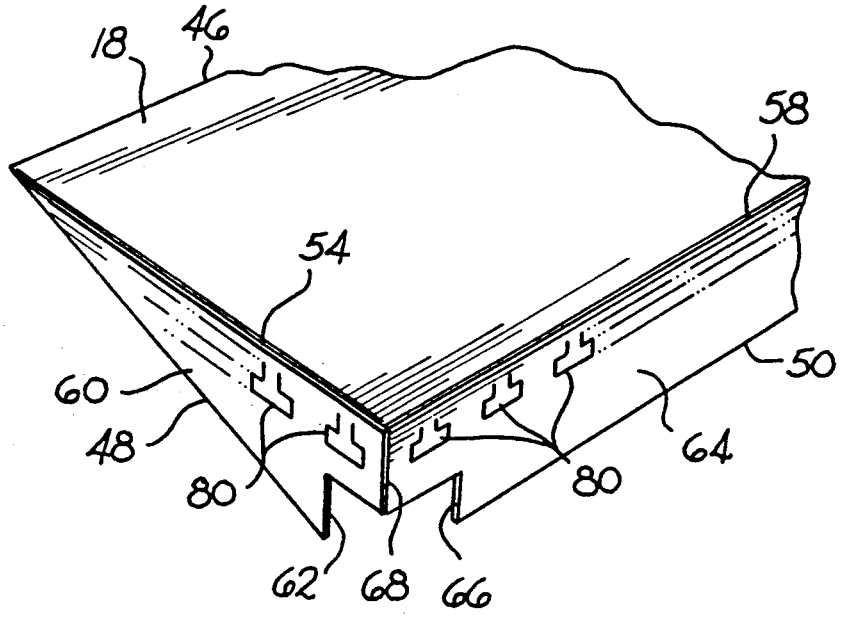
FIG. 4 illustrates a typical corner of the floor panel.

Referring to FIGS. 3 and 4, when triangular side wall 60 is bent downwardly, and rear wall 64 is bent downwardly so that its outer end is bent along fold line 68 and then received inside the side wall 60, fastener patch 70 is releasably engaged with fastener patch 74, and fastener patch 72 is releasably engaged with fastener patch 76 to form the corner illustrated in FIG. 4. In this configuration, when the corner of the floor panel is mounted on bottom frame member 20, the cut-out sections 62 and 66 overlay the corner of the tubular frame element.

Similarly, triangular side wall 75 is bent down around fold down line 56, rear wall 64 is bent around its fold line 58, and outer end of the rear wall is bent at fold line 80 and inserted inside the end of side wall 75 to form a second corner. The corner is retained in position by releasably connecting fastener patch 84 to fastener patch 88, and fastener patch 82 to fastener patch 86.

The cut-out sections 77 and 78 then are mounted over the corresponding corner of frame element 20. The rear floor panel wall then supports the rear of the floor at a height of about 6 inches above front edge 46. For illustrative purposes, the front edge has a width of about 50 inches and the distance from the front edge to rear fold line 58 is about 21 inches. These dimensions depend upon the size of the net.

Figure 5:
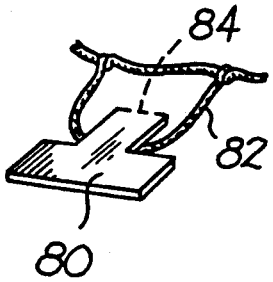
FIG. 5 illustrates the manner in which the net is connected to the floor panel.

The floor panel has a series of T-shaped, cut-out sections generally as illustrated in FIG. 5. The bottom of each T-shaped section 80 has a width and a length such that it can be received through a typical loop 82 of the net. Each T-shaped section can be bent and raised about a fold line 84 so that the loop can be easily passed around section 80 and retained under the T-shaped section. This arrangement permits the net to be releasably connected to the floor panel.

The net could also be connected to the floor panel by attaching complementary strips of hook and loop fabric fasteners around the three sides of the floor panel, and sandwiching the net between the fasteners.

Figure 6:
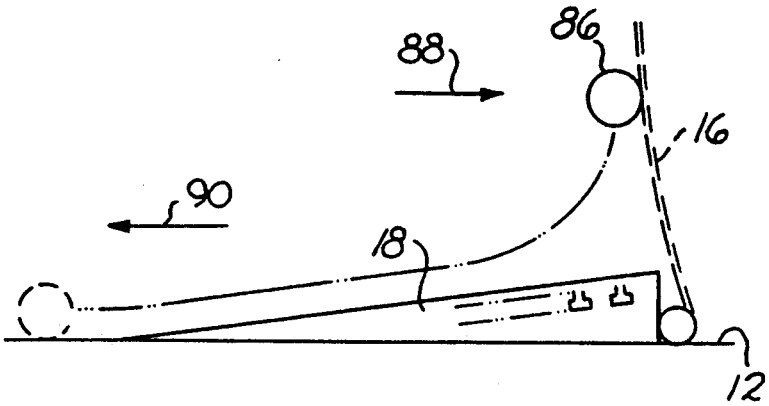
FIG. 6 illustrates the manner in which the hockey ball drops to the floor and rolls out the front opening.

The loops of the net are smaller than the diameter of street hockey ball 86. FIG. 6 illustrates ball 86 passing through the front opening of the goal, generally in the direction 88 of the arrow, and striking net 16 which terminates the horizontal travel of the ball. The ball then drops to the floor panel and rolls down and out in the direction 90 toward the user, as illustrated in phantom.

Referring to FIG. 1, silhouette 92 of a goal tender, formed of a relatively stiff material, is attached by strap means 94 to legs 22 and 26, and arm 28 of the goal opening. The silhouette simulates the appearance of a goal tender. It is to be noted that the bottom edge 96 of the silhouette is spaced above the front edge of the floor panel so as to not interfere with the return of the ball. The silhouette partially obstructs the front opening of the goal to simulate an actual goal tender.

Having described my invention, I claim:

1. Street hockey apparatus, comprising:

a ball;

a frame having a front opening and adapted to stand in an upright position on the ground;

net means mounted on the frame behind the front opening for forming a wall for receiving the ball passing through said opening;

a substantially planar, non-resilient floor disposed behind said front opening and beneath at least a portion of the net means, the floor having a front edge adjacent the front opening, and a rear edge rearward of the front opening and raised higher than the front edge such that the floor is inclined toward the front opening;

whereby a ball passing through the front opening engages the net, drops to the floor and rolls out the front opening toward the user.

2. Apparatus as defined in claim 1, including a silhouette of a goal tender mounted on the frame to partially obstruct passage of the ball through the front opening.

3. Apparatus as defined in claim 2, in which the silhouette is supported above the front edge of the floor to permit the ball to pass between the silhouette and the floor.

4. Apparatus as defined in claim 1, in which the frame comprises an upper U-shaped structure supported in a substantially horizontal position, an upright U-shaped structure supported with a pair of vertical legs having their upper ends connected to the ends of the upper U-shaped structure, and a lower U-shaped structure supported in a horizontal position beneath the upper U-shaped structure, and having its ends connected to the lower ends of the vertical legs of the upright U-shaped member.

5. Apparatus as defined in claim 1, in which the floor comprises a stiff sheet member having a rear edge supported about 6 inches higher than the front edge.

6. Apparatus as defined in claim 1, in which the floor comprises a sheet of plastic material having a rear edge and a pair of spaced side edges, and has a plurality of fingers partially cut out of the sheet adjacent the rear edge and the side edges for engaging the mesh openings of the lower edge of the net.

7. Apparatus as defined in claim 1, in which the floor comprises a substantially planar, non-resilient sheet member having a front edge, a pair of side edges, and a rear edge, the pair of side edges being bent downward along first and second parallel fold lines, and the rear edge being bent downward along a rear fold line to form a generally four-sided floor, in which the side edges and the rear edge cooperate to support the floor on the ground.

8. Apparatus as defined in claim 7, in which the rear edge is bent downwardly to form a short vertical wall, and the side edges are bent downwardly to form generally vertical, triangular side walls, and the rear wall has structure interlocking with the side walls to form a pair of rear corners, the rear corners having cut-out sections overlying sections of the tubular frame.

9. Apparatus as defined in claim 7, in which the floor has a plurality of cut-out sections formed generally parallel to three sides of the four sided floor for engaging the net.

10. Apparatus as defined in claim 9, in which the cut-out sections have a generally T-shaped configuration.

11. Apparatus as defined in claim 1, including a strap means for interconnecting the frame to the net and for interconnecting the frame to the floor.

* * * * *